United States Patent [19]

Schützle et al.

[11] Patent Number: 4,556,270

[45] Date of Patent: Dec. 3, 1985

[54] HOUSING FOR PLUG CONNECTOR

[75] Inventors: Günter Schützle, Heilbronn; Manfred Reichardt, Weinsberg, both of Fed. Rep. of Germany

[73] Assignee: Allied Corporation, Morris Township, Morris County, N.J.

[21] Appl. No.: 644,159

[22] Filed: Aug. 27, 1984

Related U.S. Application Data

[63] Continuation of Ser. No. 318,882, Nov. 6, 1981, abandoned.

[30] Foreign Application Priority Data

Nov. 6, 1980 [DE] Fed. Rep. of Germany ..... 3041938

[51] Int. Cl.[4] ..... H01R 13/629

[52] U.S. Cl. ..... 339/91 R; 339/92 M; 339/103 M; 339/206 R

[58] Field of Search ..... 339/91 R, 92 M, 17 F, 339/176 MF, 103 M, 59 R, 59 M, 206 R, 210 R, 210 M

[56] References Cited

U.S. PATENT DOCUMENTS

| | | | |
|---|---|---|---|
| 2,760,174 | 8/1956 | Burtt et al. | 339/91 R |
| 3,582,867 | 6/1971 | Thompson et al. | 339/92 M |
| 3,711,813 | 1/1973 | Bryant | 339/91 R |
| 3,824,525 | 7/1974 | Keller | 339/91 R |
| 3,951,501 | 4/1976 | Bauerle et al. | 339/91 R |
| 4,113,179 | 9/1978 | McKee | 339/91 R |
| 4,165,145 | 8/1979 | Steinbach | 339/91 R |
| 4,181,391 | 1/1980 | Kilsdonk | 339/92 M |

FOREIGN PATENT DOCUMENTS

| | | | |
|---|---|---|---|
| 7729902 | 9/1977 | Fed. Rep. of Germany . | |
| 922776 | 6/1947 | France . | |
| 531228 | 12/1940 | United Kingdom . | |
| 2042827 | 9/1980 | United Kingdom | 339/91 R |

OTHER PUBLICATIONS

Catalog Pages of Canon Electric, Minnesota Manufacturing Co., Souriau & Cie, Thomas & Betts Corp., AEG-Telefunken, and Amphenol-Tuchel Electronics.

*Primary Examiner*—John McQuade
*Attorney, Agent, or Firm*—Roger H. Criss

[57] ABSTRACT

The invention relates to a housing for a plug connector which can be detachably fastened on to a fixture which holds a matching connector. Prior art connectors have utilized housings with fastening elements which detachably fasten the connector to a matching connector. However, the prior art fastening devices have only provided one type of fastening for any given housing. According to the present invention, a housing is provided with a plurality of different interchangeable elements, each of which provides one of several possible types of fastening.

7 Claims, 13 Drawing Figures

HOUSING FOR PLUG CONNECTOR

This application is a continuation of application Ser. No. 318,882 filed Nov. 6, 1981, now abandoned.

TECHNICAL FIELD

The invention is concerned with a housing for a plug connector attached to a lead wire or cable, which housing can be fastened detachably onto a device which holds a matching connector.

BACKGROUND OF THE INVENTION

Housings of this general type are offered by Cannon Electric, Minnesota Manufacturing Company, Souriau & Cie, Thomas & Betts Corporation, AEG-Telefunken, and Amphenol-Tuchel Electronics. These housings, together with the plug connectors installed therein, can only be fastened by means of a single type of fastening to a fixture that holds the matching plug connector. Thus, for example, the housings of the first four of the above-mentioned manufacturers can in each case be mounted only by means of screws, whereas the housing of AEG-Telefunken can be mounted detachably on the device holding the matching plug connector only by means of a locking catch, and the housing of Amphenol-Tuchel Electronics only by means of a locking wire strap.

Connector housings which provide only one type of locking mechanism lack flexibility. Practically speaking, when one purchases a housing with a plug connector installed in it from a particular manufacturer, one is bound once and for all to the type of locking mechanism which is provided by the manufacturer. One cannot easily or even possibly switch over to other types of locking mechanisms, even when there are important constructional or operational reasons for doing so. For example, the screw lock may be regarded as the most statically stable type of locking mechanism, which, however, cannot be used if the housing does not provide for it. On the other hand, it may be desirable to use a catch lock of a wire strap lock because the screw lock cannot be detached rapidly enough or could beciome detached due to vibrations. In addition, the prior art housings for plug connectors permit the cable to exit the housing in only one predetermined direction. Should operational or constructional reasons dictate that the cable exit the housing in a different direction, the prior art housings have not provided such flexibility. Therefore, an object of the invention is to provide a housing of the type mentioned above which can be fastened detachably on the fixture that holds the matching plug connector by means of one of several types of fastening as desired. In addition to this it should be constructed simply and sturdy in the face of mechanical demands, should be economical to produce, and provided with a wire output opening through which the wire can be led out of the housing in different directions in such a way as to be practically free of kinking.

BRIEF DESCRIPTION OF THE INVENTION

These and other objects will be attained in accord with the invention through the fact that the housing and/or the device holding the fastening elements which are adapted to the former and mounted removably thereon are each designed for one of several possible types of fastening or locking mechanisms. In this way one and the same housing can be mounted by means of one of several possible types of fastening mechanisms respectively, without having to alter this housing itself or in any way modify it to the particular type of fastening desired.

The housing for plug connector, according to another feature of the invention, is a one-piece component which is open on its plug side for the insertion of the plug connector and otherwise covers the plug connector when in use. The housing has an opening for the cable, out of which the cable can be led out as desired either in the direction opposite that in which the plug points or in a direction colinear therewith, in such a manner as to be practically free of kinking. Along with this, in each individual case, the most favorable direction for the output of the cable can be decided at the time of attachment of the cable to the plug connector just prior to mounting it in the housing.

BRIEF DESCRIPTION OF THE DRAWINGS

The novel features believed characteristic of the invention are set forth in the appended claims. The invention itself, however, as well as a preferred mode of use and further objects and advantage thereof, will be best understood by reference to the following detailed description of an illustrative embodiment when read in conjunction with the accompanying drawings, wherein:

DETAILED DESCRIPTION OF AN ILLUSTRATIVE EMBODIMENT

Figure 1:
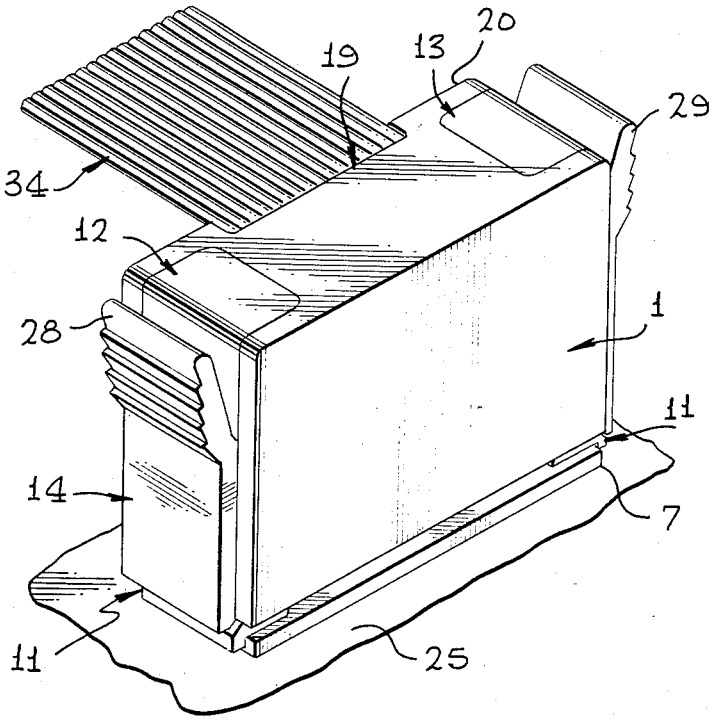
FIG. 1 is a perspective view of a housing in accordance with the invention which encloses a plug connector (not shown in this Figure) attached to a flat cable, in which case the housing is fastened to a device holding a matching plug connector (also not shown) which coordinates with the plug connector, the fastening being by means of a catch lock which is more clearly illustrated in FIG. 5.
Figure 3:
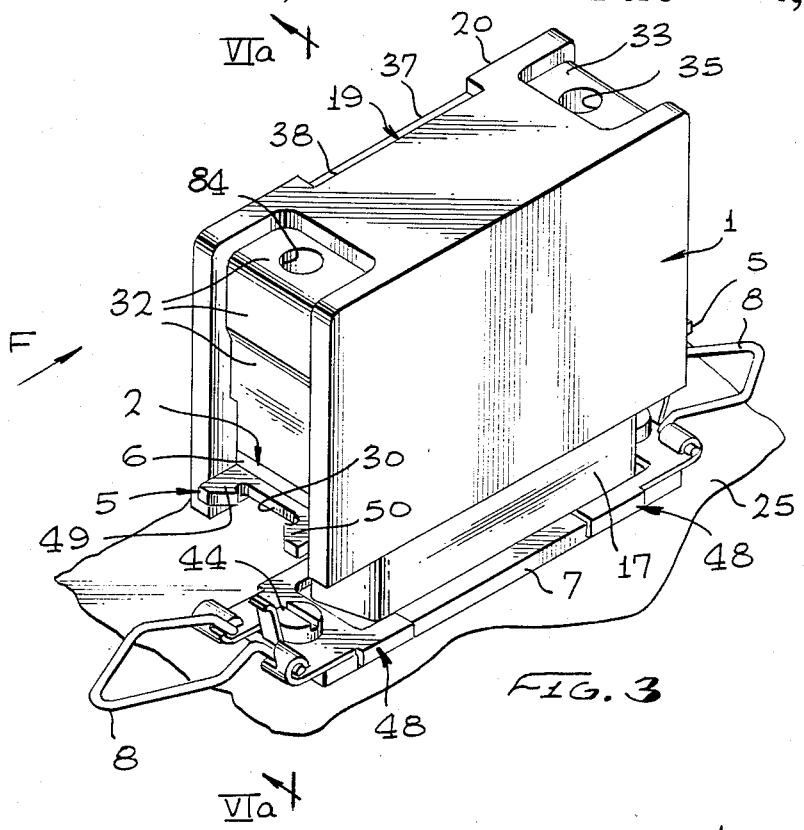
FIG. 3 is a perspective view of the housing of FIG. 2, for which a wire strap locking mechanism is provided.
Figure 4:
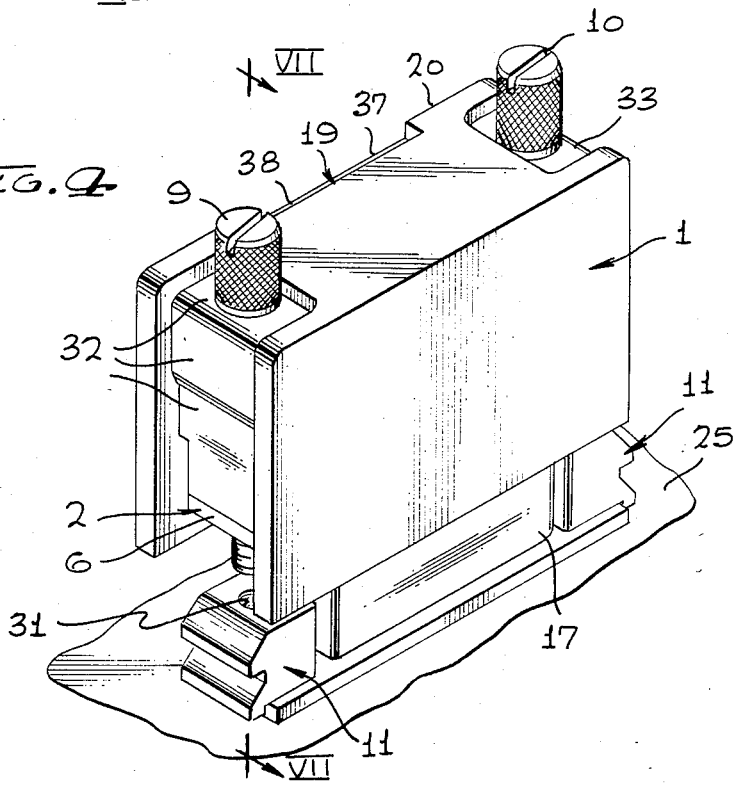
FIG. 4 is a perspective view of the housing of FIG. 2, for which a screw locking mechanism is provided.
Figure 5:
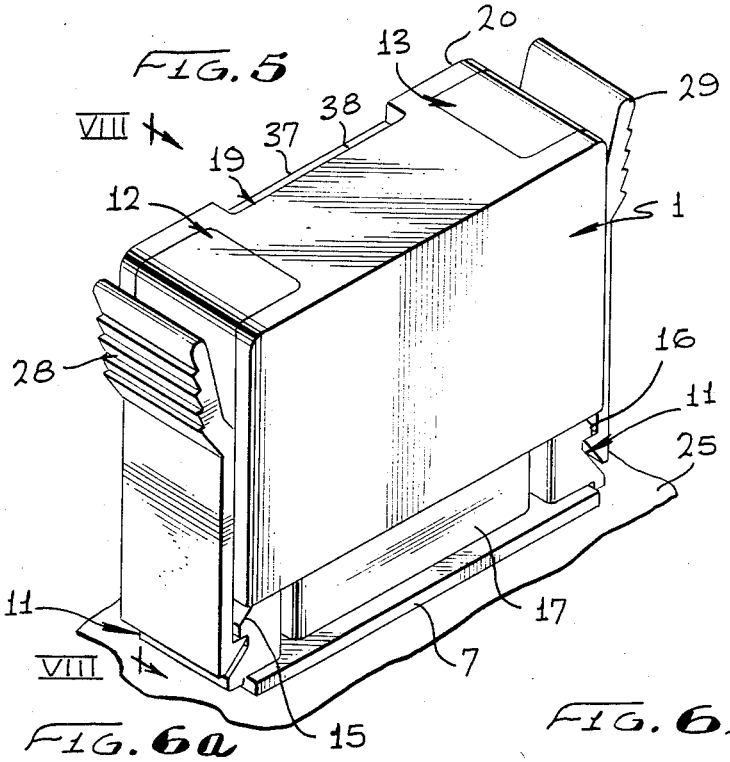
FIG. 5 is a perspective view of the housing of FIG. 2, for which a catch lock mechanism is provided (see also FIG. 1)

FIG. 1 shows a housing 1 in accord with the invention for a plug connector 2 (FIGS. 9–12) in its operational position. In connection with this, in a particular design of the invention object, it is fastened detachably onto blocks 11 by means of a catch lock 12, 13, 14, 28, 29, the blocks in turn being mounted detachably on a flange 6 of the plug connector 2. The flange 7 is in turn mounted detachably onto a fixture 25 which holds a matching plug connector 17 (FIGS. 3–5). The fixture 25 can, by way of example, be the front plate, or housing, of an electronic device, a support frame, a so-called "rack and panel", or something similar. A flat cable 34 (see also FIGS. 9–12) is coupled to plug connector 2, the flat cable 34 being led out of a wire opening 19 that is provided of the cable side of the housing 1 and runs along an edge 20 of the housing 1. The wire opening 19 is bordered on both sides by edges 37, 38 that are approximately parallel to each other and almost touch the cable 34 in operating position, in order to hold the housing 1 closed as much as possible even in the area of the opening 1.

Figure 2:
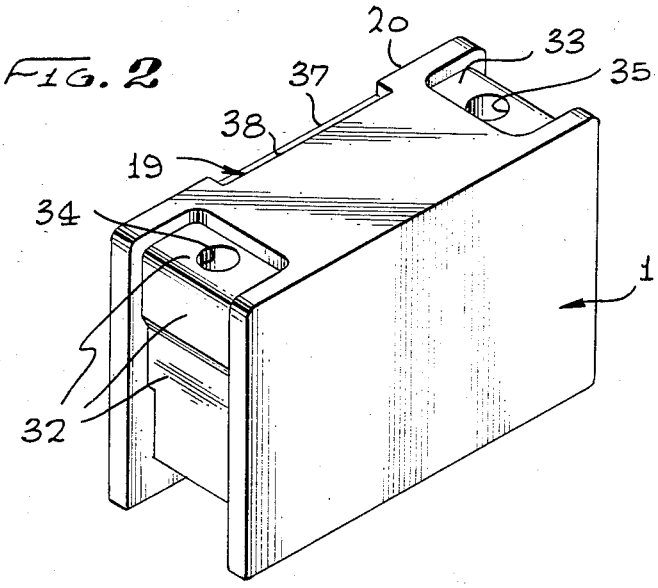
FIG. 2 is a perspective portrayal of the empty housing with no fastening mechanism attached to it.

The housing 1 is, as FIG. 2 depicts, preferably a one-piece, somewhat block-shaped component, which is open on the plug side for the insertion of the plug connector 2 but otherwise, however, encases the plug connector 2 on all sides. The housing 1 is provided preferably on its two narrow sides with recesses 32, 33 for detachably mounting, for example, molded parts 12, 13 (in case the housing 1 is to be mounted by means of a catch lock, as depicted in FIGS. 1 and 5). The recesses, however, are not absolutely necessary. The shape, the type of holding, and the function of the molded parts 12, 13 will be explained subsequently in greater detail with respect to FIG. 8.

FIGS. 3 through 5 illustrate how the housing 1 portrayed in FIG. 2 can be mounted without an alteration onto the fixture 25 with the aid of particular fastening elements of three different types.

Figure 6A:
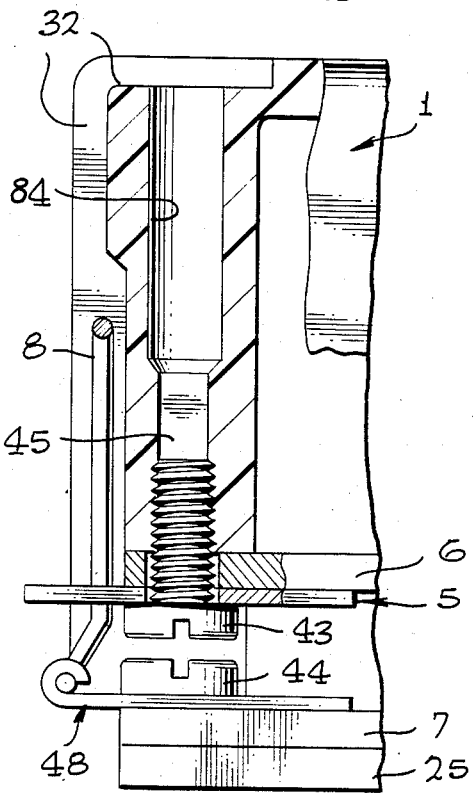
FIG. 6*a* is an enlarged partial longitudinal section through the housing with wire strap lock in its operational position taken along Line VIa—VIa in FIG. 3.
Figure 6B:
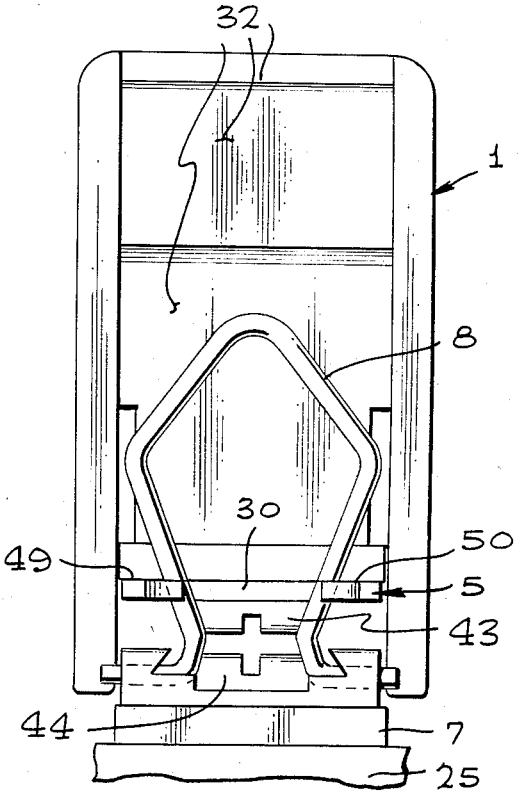
FIG. 6*b* is an enlarged side view of the housing with wire strap lock in its operational position, the view being taken in direction F shown on FIG. 3.

FIGS. 3, 6*a* and 6*b* show the housing 1 secured with a so-called wire strap lock. A hinged part 48 is installed detachably on both ends of the flange 7 by means of a screw 44, onto which hinged part in turn a conventional catch bar 8 is pivotably attached. On flange 6 of the plug connector 2, at both of its ends, a catch part 5 is detachably mounted by means of a screw 43. On both ends respectively the catch part 5 has generally C-shaped recesses or notches 30, notches 30 including lands 49,50 for engaging catch bar 8 in the manner shown in FIGS. 6*a* and 6*b*.

Figure 7:
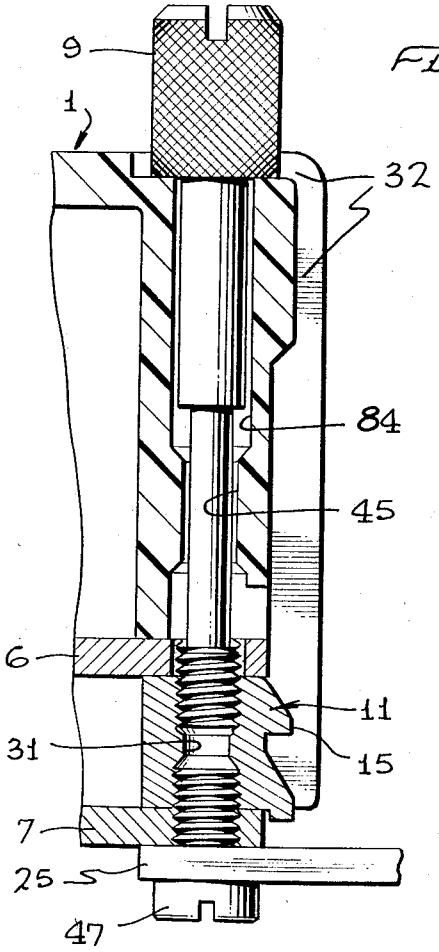
FIG. 7 is an enlarged partial longitudinal section through the housing with screw lock in its operational position, taken along Line VII—VII in FIG. 4.

FIGS. 4 and 7 depict the housing 1 mounted with a so-called screw lock. For this, on both ends of the flange 7 of the matching plug connector 17 is detachably mounted a block 11, each block 11 having a threaded hole 31 passing through it. Each block 11 is mounted by means of a screw 47 inserted from the underside of the flange 7, screw 47 preferably being screwed into the aforementioned threaded hole 31 of the block 11 up to a maximum of half the depth of the threaded hole. From the other side a knurled-head screw 9, 10, inserted through an associated opening 84, 35 in housing 1 and is screwed into the threaded hole 31 of the block 11.

Figure 8:
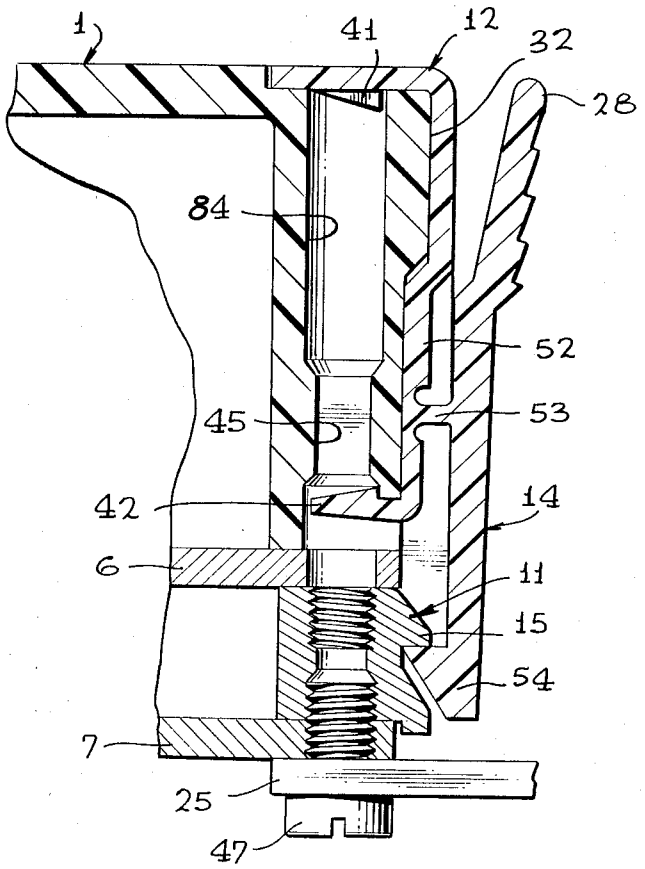
FIG. 8 is an enlarged partial longitudinal section through the housing with catch lock in its operational position taken along Line VIII—VIII in FIG. 5.

As FIGS. 7 and 8 show, the openings 84, 35 have each a smaller cross section or narrow place 45 at approximately half length, the cross section of which is preferably square. The cross section of the narrow place 45 is dimensioned exactly so that the end of the thread of the knurled-head screw 9, 10, which is made somewhat thicker by comparison with the rest of the screw shaft, can be screwed through this narrow place 45 with a small amount of torque. This narrowing 45 is provided in particular as a tapping drill hole for the screw 43 used in the catch-bar locking assembly described above.

FIGS. 5 and 8 illustrate the previously mentioned catch lock. In this case, the holding device 11 on the fixture 25 is preferably the same as the one for the screw lock which was just explained. The block 11, in addition to being provided with a threaded hole 31, is also provided with a catch projection 15, 16. Housing 1 is provided with molded parts 12, 13 installed in recesses 32, 33 on its two narrow sides. The details of the shape of the molded parts 12, 13 as well as the means for mounting them on the housing 1, may be ascertained clearly and particularly from FIG. 8. Every molded part 12, 13 has a base section 52 which is constructed approximately U-shaped or C-shaped and is provided on its two angular ends which run approximately parallel to each other with catch dogs 41, 42. Catch dogs 41, 42 are turned toward each other and lie approximately in alignment, and, in use, engage the ends of openings 84, 35 from both sides to hold parts 12, 13 in place on housing 1. A catch element 14 is attached to the middle of the base section 52. Element 14 can execute arresting movements with the bar 53 as center of rotation or center of gravity. The upper end of element 14 has an activating handle 28, 29, while the lower end end is provided with a protrusion or detent 54 which cooperates with the catch projection 15, 16 of the block 11 when in use. The activating handles 28, 29 may be simply moved toward each other, as for example with the index finger and thumb of one hand, to disengage the catch lock, in which case the detents 54 which were heretofore locked onto the catch projections 15, 16 are freed. The housing 1 can thereupon, together with the plug connector 2 installed therein, be removed upwardly, in which case the plug connector 2 is pulled out of the matching plug connector 17 mounted on the fixture 25.

FIGS. 9 through 12 each show finally cross sections of the housing 1 according to the invention, with the plug connector 2 installed therein and the lead wire 3 (of standard design) or 4 (of sheathed design) connected to the plug connector 2. The plug connector 2 has on each side a shoulder 21 or 22, and the housing 1 has corresponding protrusions or built-in detents 23 or 24 for locking the connector 2 in the housing 1 in its operating position.

Figure 9:
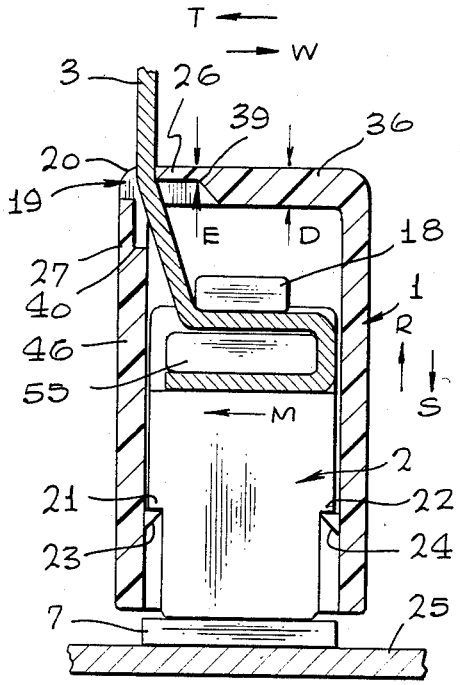
FIG. 9 is a schematic cross section of the housing enclosing a plug connector with a standard design flat cable led out in direction R, which is opposite to the directions in which the plug points.
Figure 10:
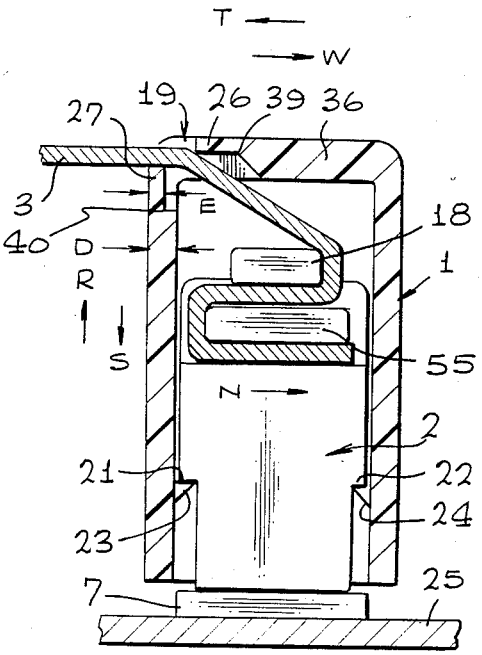
FIG. 10 is a schematic cross section of the housing enclosing a plug connector with a standard design flat cable led out at a right angle to the directions in which the plug points.
Figure 11:
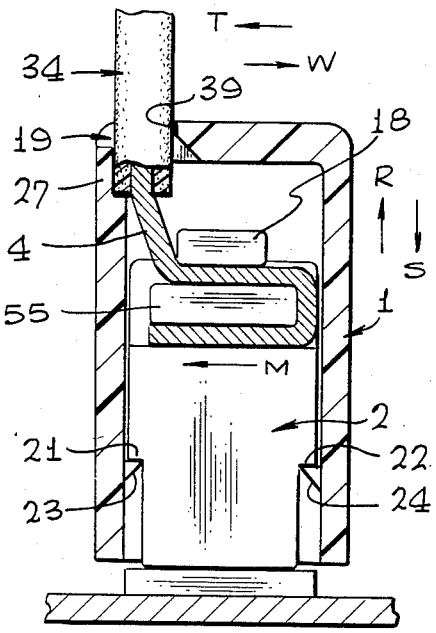
FIG. 11 is a schematic cross section of the housing enclosing a plug connector with a flat cable in sheathed design led out in direction R, which is opposite to the directions in which the plug points.
Figure 12:
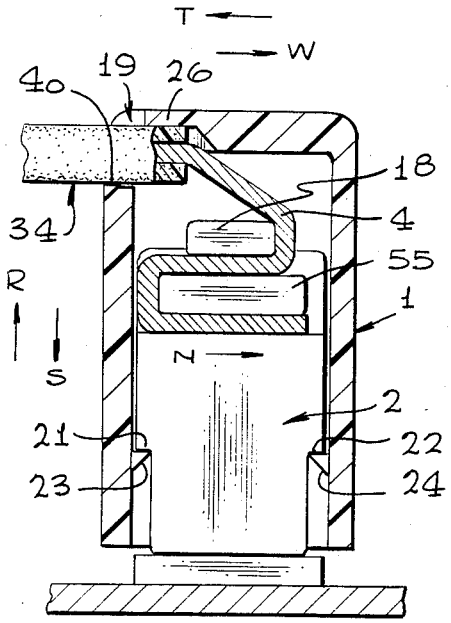
FIG. 12 is a schematic cross section of the housing enclosing a plug connector with a flat cable in sheathed design led out at a right angle to the direction in which the plug points S.

FIGS. 9 and 11 depict the lead wire 3 or 4, which leaves the housing 1 in a direction R which is approximately opposite to the directions of engaging the plug. FIGS. 10 and 12 show the wire 3 or 4 leaving the housing 1 in an output direction T generally at a right angle to the directions in which the plug is plugged in.

The housing 1, as portrayed in FIGS. 9 through 12, has an edge or rim 20 on its left upper corner along which a wire opening 19 is constructed. The housing walls 36 and 46 on both sides of the wire output opening 19 is reduced from its normal wall thickness D to wall thickness E. At the place of the seam between the normal wall thickness D and the reduced wall thickness E preferably in each case a breaking point 39 or 40 is constructed. When a wire 3 of standard design is used (FIGS. 9 and 10), the housing 1 is used unaltered. When a wire 4 is used (FIGS. 11 and 12), the reduced wall piece 26 is broken off when the wire is inserted according to FIG. 11, while according to FIG. 12, in inserting the wire, the reduced wall piece 27 is removed, in which case the fissure, as a result of the breaking points 39 or 40 have been provided, in every case runs along a practically straight line. In this way one and the same housing can be used not only for receiving cable 3, 4 from different directions, but also for cables of different thicknesses.

As FIGS. 9 through 12 show, the cable 3 or 4 is always connected to the plug connector 2 either in output direction M or in output direction N, secured in this connection position by means of a wire holder 55. The cable 3 or 4 is protected against tensile stress which could affect the part of the cable 3 or 4 which is outside the housing 1 by means of a traction relief device 18, in such a way that no further strain occurs on the connecting end of the cable 3 or 4.

The position of the wire output opening 19 and the direction R or T of the wire output can, as is to be illustrated by FIGS. 9 and 10, be affected either by the respective connection direction M or N of the cable 3 on the plug connector 2, or by the respective installation of the housing 1 over the plug connector 2. If, for example, as is shown in FIG. 9, the wire output opening 19 occurs at the left upper corner of the housing 1, and if the cable 3 is to be led out of the housing 1 in direction R, then cable 3 must be connected to the plug connector 2 in connection direction M. If, however, as is shown in FIG. 10, the wire output opening 19 still is positioned at the left upper corner of the housing 1, but cable 3 is to be led out of the housing 1 in direction T, then cable 3 must be connected to the plug connector 2 in connecting direction N.

On the other hand, opening 19 should lie at the right upper corner of the housing 1, and cable 3 is to be led out of the housing 1 in direction R, then cable 3 must be connected to the plug connector 2 in connecting direction N, in which case the leading of the wire 3 runs symmetrically to the cable layout portrayed in FIG. 9. If the opening 19 lies at the right upper corner of the housing 1, but cable 3 is to be led out of the housing in direction W, then cable 3 must be connected to the plug connector 2 in connecting direction M, in which case the leading of the wire 3 runs symmetrically to the cable layout portrayed in FIG. 10.

Considerations regarding the position and direction of the wire output are particularly important when construction or spatial reasons dictate definite layout of the cable, either upwardly, to the left, or to the right.

Housing 1 may be manufactured of a dielectric material, such a a molded plastic, or, if desired, of an electrically conductive material, such as a metal.

We claim:

1. A connector assembly for mating a plug connector with a matching connector, said assembly comprising a one-piece housing and a plug connector mounted in said housing and extending in a connector extending direction, said housing having a generally block shape defined by top and bottom walls, a back portion joining said walls, and two narrow side walls extending forwardly between said top and bottom walls from said back portion to an open front portion; said housing including a laterally extending slot adjacent the intersection of one of said top and bottom walls with said back portion;

said housing including aperture means on said back portion adjacent said side walls and extending to said front portion and adapted to receive fastening screws to fasten said housing to said matching connector;

said side walls having receiving means adapted to receive a detachable catch part for lockingly receiving wire strap means mountable on said matching connector for fastening said plug connector to said matching connector;

said housing adapted to receive a detachable mounting block at said front portion thereof adjacent said side walls, said mounting block having catch projection means for receiving detachable catch element means mountable on said housing for fastening said plug connector to said matching connector;

flat electrical cable extending through said slot in said housing and being connected to said plug connector; and means associated with said plug connector for leading said flat cable out of said housing in either of two directions, the first of said directions being opposite to said connector extending direction and the second of said directions being at right angles to said connector extending direction.

2. The connector assembly of claim 1 wherein the thickness of the walls bordering said slot is reduced.

3. The connector assembly of claim 2 including breaking points on seams between regions of normal wall thickness and reduced wall thickness, whereby portions of said housing walls can be broken off.

4. The connector assembly of claim 3 including a tension relief device connecting said cable and said plug connector.

5. The plug connector of claim 1 including recesses in said side walls extending from said back portion to said front portion, said recesses being adapted to receive said catch lock means and said catch part.

6. The plug connector of claim 5 wherein said recesses are adapted to receive said catch part substantially transverse of said recesses.

7. The plug connector of claim 5, including recess portions in said back portion, said recess portions being in communication with said recesses of said side walls and adapted to receive a part of said catch lock means.

* * * * *